US010197060B2

(12) United States Patent
Dowling

(10) Patent No.: US 10,197,060 B2
(45) Date of Patent: Feb. 5, 2019

(54) GAS LOCK RESOLUTION DURING OPERATION OF AN ELECTRIC SUBMERSIBLE PUMP

(71) Applicant: Schlumberger Technology Corporation, Sugar Land, TX (US)

(72) Inventor: Michael A. Dowling, Stavanger (NO)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 491 days.

(21) Appl. No.: 14/786,372

(22) PCT Filed: Apr. 22, 2014

(86) PCT No.: PCT/US2014/034929
§ 371 (c)(1),
(2) Date: Oct. 22, 2015

(87) PCT Pub. No.: WO2014/176225
PCT Pub. Date: Oct. 30, 2014

(65) Prior Publication Data

US 2016/0084254 A1 Mar. 24, 2016

Related U.S. Application Data

(60) Provisional application No. 61/814,351, filed on Apr. 22, 2013.

(51) Int. Cl.
*F04D 9/00* (2006.01)
*F04D 27/00* (2006.01)
(Continued)

(52) U.S. Cl.
CPC ..... *F04D 9/002* (2013.01); *F04D 9/007* (2013.01); *F04D 13/08* (2013.01);
(Continued)

(58) Field of Classification Search
CPC ..... F04D 13/06; F04D 13/08; F04D 13/086; F04D 13/10; F04D 27/008; F04D 27/004;
(Continued)

(56) References Cited

U.S. PATENT DOCUMENTS 4,867,242 A 9/1989 Hart
5,011,551 A 4/1991 Emeric et al.
(Continued)

FOREIGN PATENT DOCUMENTS

RU 2102633 C1 1/1998
RU 2319864 C1 3/2008
WO WO2013130536 * 9/2013

OTHER PUBLICATIONS

European Search Report issued in related EP application 14788029.8 dated Jun. 17, 2016, 4 pages.
(Continued)

*Primary Examiner* — Bryan Lettman

(57) ABSTRACT

Gas lock resolution during operation of an electric submersible pump is provided. An example method, module, or computing hardware with software product, detects a gas lock during current operation of an electric submersible pump (ESP) and intervenes to relieve the gas lock without stopping the ESP. After sensing a gas lock condition, an example module calculates a pump speed for attempting gas lock resolution. The example module may decrease the speed of the ESP to flush the gas lock, and then reaccelerate the ESP to check that the gas lock has been eliminated. The example module may apply one or more stored motor speed patterns that iteratively seek a pump speed that succeeds in clearing the gas lock, without stopping the ESP. The example module has built-in protections to protect the ESP from thermal overload and other damage.

15 Claims, 7 Drawing Sheets

(51) Int. Cl.

| | |
|---|---|
| ***F04D 15/00*** | (2006.01) |
| ***F04D 13/08*** | (2006.01) |
| ***F04D 31/00*** | (2006.01) |
| *F04D 13/10* | (2006.01) |
| *E21B 43/12* | (2006.01) |
| *E21B 47/00* | (2012.01) |

(52) U.S. Cl.
CPC ..... *F04D 15/0027* (2013.01); *F04D 15/0066* (2013.01); *F04D 15/0077* (2013.01); *F04D 27/004* (2013.01); *F04D 27/008* (2013.01); *F04D 31/00* (2013.01); *E21B 43/128* (2013.01); *E21B 47/0007* (2013.01); *F04D 13/10* (2013.01)

(58) Field of Classification Search
CPC .... F04D 15/0077; F04D 15/0066; F04D 9/00; F04D 9/001; F04D 9/002; F04D 9/007; F04D 15/0027; F04D 31/00; F04B 49/103; F04B 49/20; F04B 49/06; F04B 49/065
See application file for complete search history.

(56) References Cited

U.S. PATENT DOCUMENTS

| | | | | |
|---|---|---|---|---|
| 8,141,646 | B2 * | 3/2012 | Allen | F04D 9/001 166/105 |
| 2008/0067116 | A1 * | 3/2008 | Anderson | E21B 47/042 210/100 |
| 2009/0000789 | A1 * | 1/2009 | Leuthen | E21B 43/128 166/369 |
| 2009/0211753 | A1 * | 8/2009 | Emtiazian | E21B 43/121 166/250.03 |
| 2009/0250210 | A1 * | 10/2009 | Allen | F04D 9/001 166/250.15 |
| 2012/0027630 | A1 * | 2/2012 | Forsberg | E21B 43/128 417/423.3 |

OTHER PUBLICATIONS

Office Action issued in related EP application 14788029.8 dated Jul. 15, 2016, 5 pages.

* cited by examiner

GAS LOCK RESOLUTION DURING OPERATION OF AN ELECTRIC SUBMERSIBLE PUMP

BACKGROUND

A gas lock may occur when liquid and gas separate in the tubing above an electric submersible pump (ESP) and inside the pump itself. The ESP may be a multistage ESP with multiple ganged pumps powered by one or more motors. In the tubing, the liquid and gas characteristically separate with the gas on top and the liquid on the bottom, effectively forming a plug above the ESP against fluid flow. Inside the pump, by contrast, the situation may be reversed, with the liquid on the top and the gas on the bottom. The liquid level in the pump is based on the amount of fluid in the tubing above the ESP and the pressure that each stage produces at zero flow. The gas in the bottom of the pump is effectively a bubble preventing more fluid from entering the pump.

BRIEF DESCRIPTION OF THE DRAWINGS

The detailed description is set forth with reference to the accompanying figures. In the figures, the left-most digit(s) of a reference number identifies the figure in which the reference number first appears. The same numbers are used throughout the figures to reference like features and components.

For this discussion, the devices and systems illustrated in the figures are shown as having a multiplicity of components. Various implementations of devices and systems, as described herein, may include fewer components and remain within the scope of the disclosure. Alternately, other implementations of devices and systems may include additional components, or various combinations of the described components, and remain within the scope of the disclosure.

DETAILED DESCRIPTION

Overview

This disclosure describes example gas lock resolution during operation of an electric submersible pump (ESP). Features, systems, and methods for detecting and resolving (e.g., breaking) a gas lock in an electric submersible pump (ESP), while the ESP is currently operating, are provided. An example system contains a module or a software product that senses a gas lock while a pump or an ESP string is running, and applies actions to the pump system, while still running, to remedy the gas lock and return the pump system to its full production, without fully stopping. However, the example system also contains built-in protections, so that the example module or software product prevents motors and pumps of the system from damage from the gas lock or the gas lock remedial measure applied. A pump motor can be harmed, depending on the particular configuration, for example, if it overheats, runs dry too long, undergoes too great a load, operates at too low of a voltage, and so forth.

Example System

Figure 1:
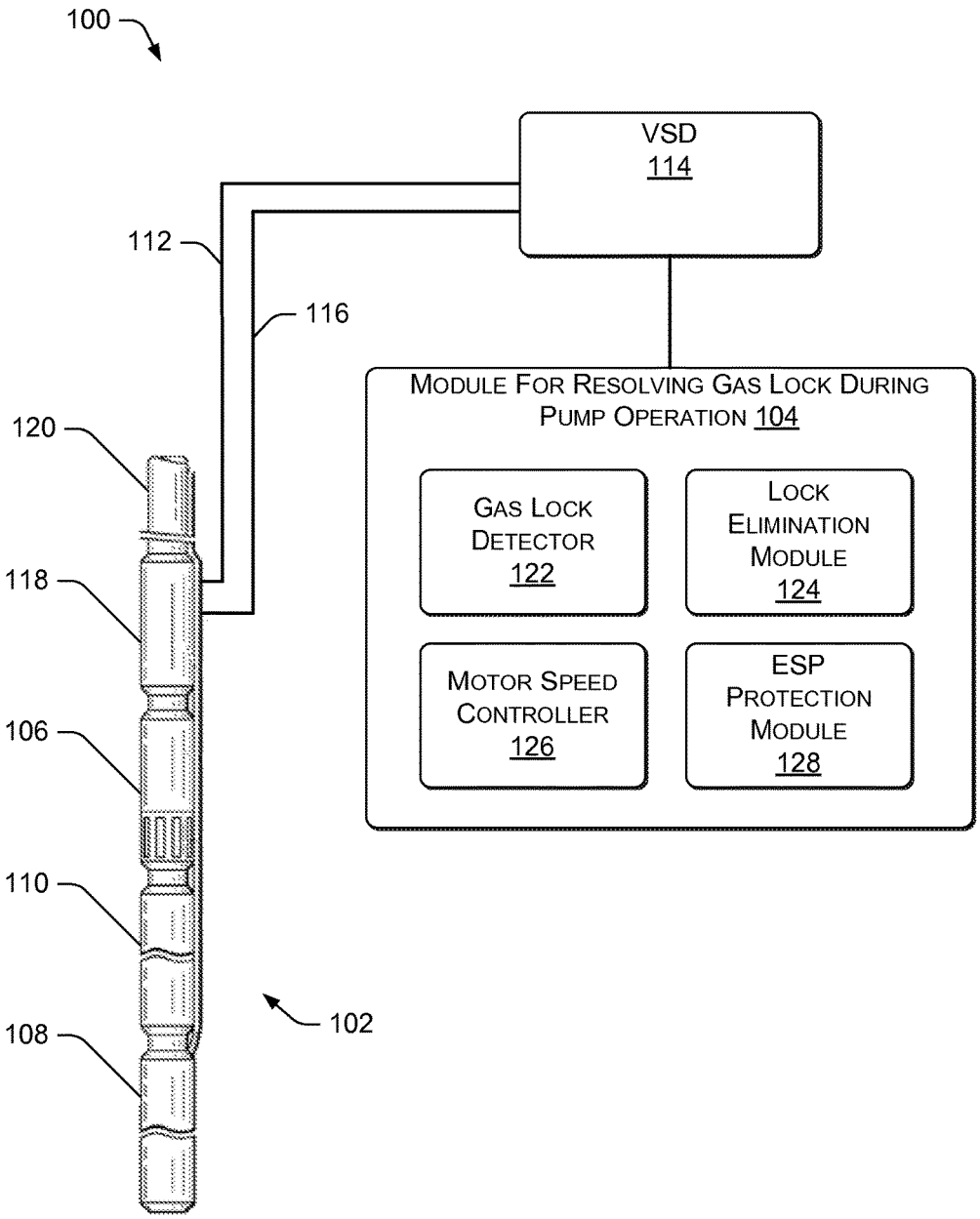
FIG. 1 is a block diagram of an example ESP system including a variable speed drive that has access to an example gas lock resolution module.

FIG. 1 shows an example pumping system 100 that includes an electric submersible pump (ESP) 102, a surface controller, such as variable speed drive (VSD) 114, and an example gas lock resolution module 104 for eliminating trapped gas ("gas lock") that may occur while the ESP 102 is running. Gas lock causes loss of suction and fluid thrust while the pump 102 is running, effectively causing a production plug, and can foster impeller cavitation, motor degradation, and other damaging effects.

The example pumping system 100, and specifically the ESP 102, may include a variety of functional sections and components depending on the particular application or environment in which the system 100 is used. Component sections of the example ESP 102 may include, for example, at least one pump 106, at least one motor 108, and at least one motor protector 110 between each pump 106 and associated motor 108. Instances of these component sections may be coupled together to form repeating stages or segments of the example ESP 102, referred to as an ESP string.

Power is provided to the example ESP 102 via a power cable 112 connected between a pump controller, such as a variable speed drive (VSD) 114, and the motor 108. Other sensing and control cables 116 may also accompany the power cable 112 along its route between the VSD 114 and the motor 108 of the ESP 102. The motor 108 in turn, drives the pump 106, which draws in production fluid from the surrounding well. Within the pump 106, for example a centrifugal pump, multiple impellers may rotate to impel the production fluid through a connector section 118 and through production tubing 120 to a desired collection destination on the ground surface above.

The example pumping system 100 is only one example of many types of submersible pumping systems that can benefit from the features described herein. Multiple pump stages 106 and multiple motors 108 can be added to the ESP lineup to make a longer string. Additionally, the production fluids may be pumped to a collection location partly through an annulus space around the ESP 102. The example ESP 102 can use different types of pump stages, such as centrifugal, mixed flow, radial flow stages, and so forth.

In an implementation, when a gas lock occurs, the example gas lock resolution module 104 attempts to break or resolve the gas lock, for example, by strategically slowing down the speed of the ESP. The example gas lock resolution module 104 may control the variable speed drive (VSD) 114 to vary power (voltage and/or amperage) to one or more motors 108 to implement the gas lock resolution. In one scenario, slowing down the ESP 102 decreases the pressure that each stage of the ESP 102 produces, pushing the liquid level lower. As the speed decreases, the pressure that the entire pump 102 produces eventually decreases to the point at which the entire pump 102 cannot support the weight of the fluid in the production tubing 120 above it, effectively flushing all the gas from the pump 102. At that point, the ESP 102 can be reaccelerated to a normal or nominal operating speed, and during this gas-lock-breaking process, the ESP 102 never has to stop. Enabling the ESP 102 to continue running during elimination of a gas lock has numerous advantages, including avoiding an enormous energy requirement needed to restart induction motors from a standstill, and avoiding load and wear on bearings, races, and thrust washers when the ESP string 102 has to begin moving all of the liquid above it from a standstill. Thus, resolving a gas lock while the ESP 102 is running prevents the loss of the entire lift momentum of the column of liquid in the production tubing 120 above the pump 102, which is under significant hydrostatic pressure.

Example System Configurations

In FIG. 1, the example gas lock resolution module 104 may include various components, such as a gas lock detector 122, a lock elimination module (or logic) 124, a motor speed (or frequency) controller 126, and an ESP protection module 128, for example. The gas lock resolution module 104 shown in FIG. 1 is only one example of a gas lock breaker or resolver for use with operating ESP's 102. Other configurations of the gas lock resolution module 104 with different components or different arrangement of components are contemplated within the scope of the representative examples described herein.

Figure 2:
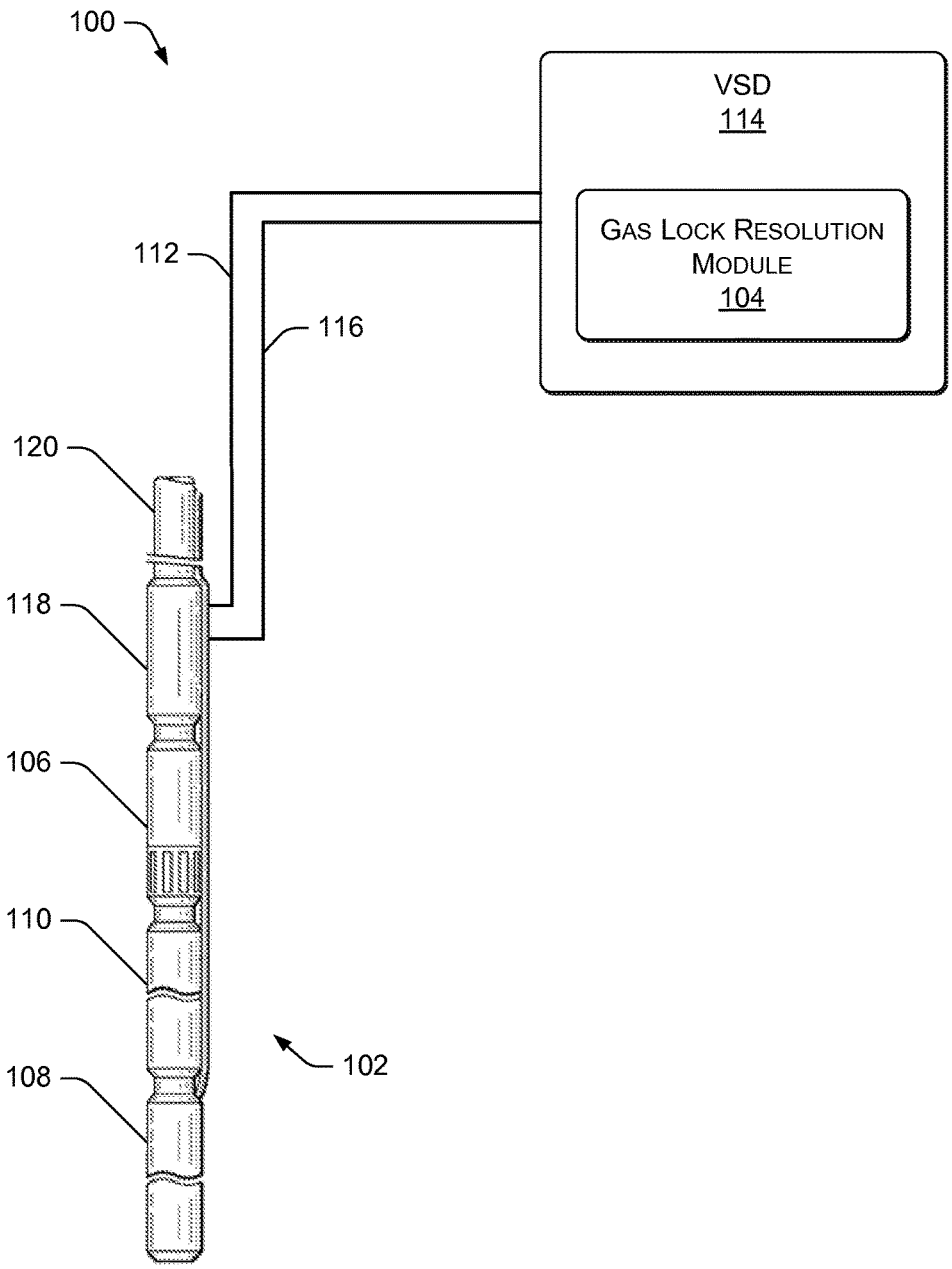
FIG. 2 is a block diagram of an example ESP system including a variable speed drive that includes an example gas lock resolution module.

FIG. 2 shows the gas lock resolution module 104 of FIG. 1 as part of the VSD 114 or other ESP controller, as opposed to a separate module differentiated from the VSD 114, as in FIG. 1. The gas lock resolution module 104 may be built into the fabric of the VSD 114 or may be added as a retrofit or option, for example.

Figure 3:
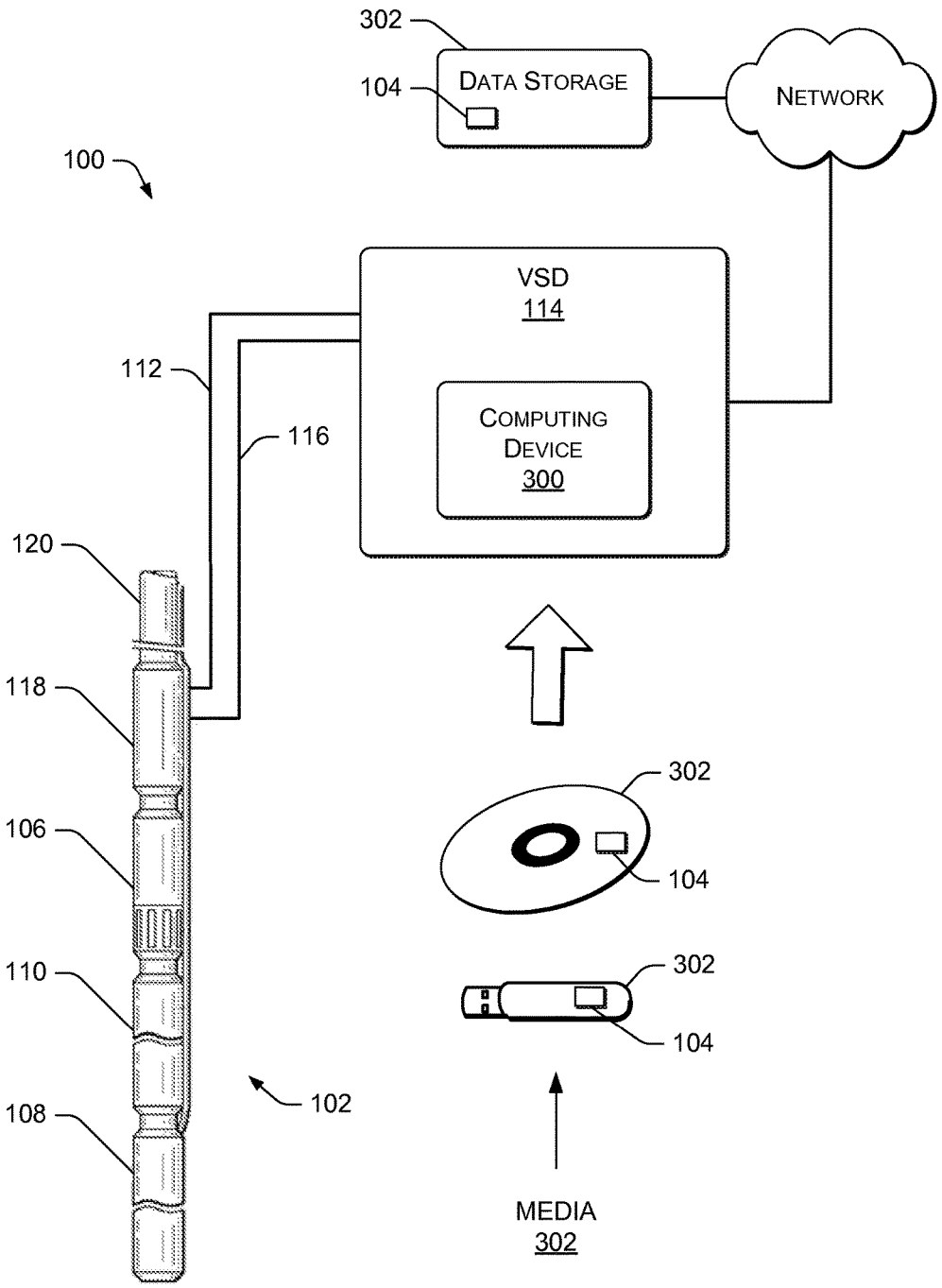
FIG. 3 is a block diagram of an example ESP system including a variable speed drive that includes a computing device capable of running example gas lock resolution instructions from a tangible data storage medium.

FIG. 3 shows an example VSD 114 that contains a computing device 300, or that has intrinsic computing powers and components. The example VSD 144 is capable of receiving tangible data storage media 302 or communicating with tangible data storage media 302 containing the gas lock resolution module 104 as an application, software, programming instructions, computer program, executable code, machine instructions, and so forth. A tangible data storage medium 302 may be an optical disk, a flash drive, a remote hard drive, a remote Internet server, and so forth.

Example Gas Lock Resolution

Referring to FIG. 1, the gas lock detector 122 of the gas lock resolution module 104 can detect a gas lock in numerous ways. In an implementation, the gas lock detector 122 detects a gas lock via a surface flow meter, i.e., when flow becomes equal to zero, but the speed of the motor 108 or pump 106 does not equal zero. This technique provides a logical and sometimes easy way to detect a gas lock in the example system 100, when downhole monitoring is difficult because of temperature, as with steam-assisted gravity drainage (SAGD), or when significant surface measurement is already available at a particular site. In some systems, a surface controller (114) can determine that the ESP 102 is still operational (still rotating or attempting to pump).

The gas lock detector 122 may also detect a gas lock by changes or stabilizations in measured amperage, for example, from the VSD 114 to the ESP 102. Depending on the specifics of the particular gas lock that has occurred and the particular pump curve, a drop and/or stabilization in measured amperage may indicate that an ESP 102 is gas locked. This technique is particularly useful for applications that have no downhole gauge.

In an implementation, the gas lock detector 122 uses an increase in pump intake pressure (PIP) to diagnose a gas lock for the ESP 102. When no flow rate measurements are available, the downhole annulus pressure near the pump 106 (hence, "pump intake pressure") is serviceable for detecting gas lock. If the pump 106 is gas locked, the pump intake pressure, PIP, will increase, with the rate of increase dependent on the well specifics (casing size, tubing size, well productivity, etc.). A known rate of pressure increase for an individual ESP 102 and well can provide a configurable setting in a drive 114 or other surface unit that is measuring the pump intake pressure (PIP). The surface unit may also be "smart" and in an implementation can learn the rate of increase based on shut downs or changes in speeds.

Combined measurements or features may also be used by the gas lock detector 122 to detect gas lock, for example, the gas lock detector 122 can use a combination of variables selected from amperage measurement, pump intake pressure, motor temperature, discharge pressure, and so forth.

The gas lock detector 122 may also apply downhole flow monitoring to detect gas lock. Downhole flow measurements can indicate a gas lock directly and immediately. Downhole flow measurement can be gathered by tools such as a triple-pressure permanent gauge or an ESP gauge that has a venturi flow meter. A zero downhole flow rate while the ESP 102 is running can indicate gas lock immediately.

Once a gas lock is detected, then the gas lock elimination module 124 begins implementing automatic breaking or other resolution of the gas lock. The gas lock elimination module 124 also aims to determine whether the resolution of the gas lock has been successful.

In an implementation, the gas lock elimination module 124 signals the motor speed controller 126 to decrease the speed of the ESP 102 to a lower speed corresponding to a frequency of approximately 35 Hertz for approximately five minutes. Then the gas lock elimination module 124 reaccelerates the ESP 102 to a nominal speed to determine if flow at the surface is reestablished. If the intervention does not resume the flow, then in an example implementation, the ESP protection module 128 shuts down the ESP 102. Shutting down the ESP 102 can break the gas lock (albeit this stops the ESP too) but more importantly protects the motor from overheating, from cavitation, and so forth.

In an implementation, the gas lock elimination module 124 calculates an effective pump speed for resolving the gas lock. The calculation can use a downhole measurement of differential pressure (e.g., discharge pressure minus intake pressure) or an estimation of the differential pressure. The gas lock detector 122 may have access to sensor data from a downhole monitor that measures intake pressure and discharge pressure. The gas lock elimination module 124 then calculates the pump speed effective to break the gas lock. For example, the VSD 114 or other surface controller may have a nominal reference frequency ($\omega_{REF}$) and may also have possession of the pressure that the installed ESP generates at zero flow, at the reference frequency ($P_{REF}$). Then, with a measured differential pressure ($\Delta P$) during gas lock, the gas lock elimination module 124 calculates the expected effective speed to break the gas lock, as in example Equation (1):

$$\omega = \omega_{REF}\sqrt{\frac{\Delta P}{P_{REF}}}$$

The gas lock elimination module 124 may implement safety factors with this strategy and example calculation. For example, the gas lock elimination module 124 may apply a speed to break the gas lock that is associated with a frequency that is approximately 1 Hertz lower (for example) than that of the calculated effective speed, or may use a percentage of the calculated effective speed, such as 90% of the calculated effective speed, to break the gas lock. This builds-in some tolerance for the variability of the densities of the fluids being pumped by the ESP 102.

Instead of measuring the differential pressure, the example gas lock elimination module 124 may estimate an effective speed for breaking the gas lock by measuring an intake pressure, and then estimating or assuming the discharge pressure, proceeding with the example calculation above in Equation (1). For example, the VSD 114 or other controller may already be in possession of a set value for the estimated discharge pressure that can be used in the example calculation of Equation (1). Or, the gas lock elimination module 124 may extend a user interface and ask for user-provided settings, such as a percentage of the intake pressure, or "%-full" entry that can be used to estimate an effective discharge pressure for breaking the gas lock.

Figure 4:
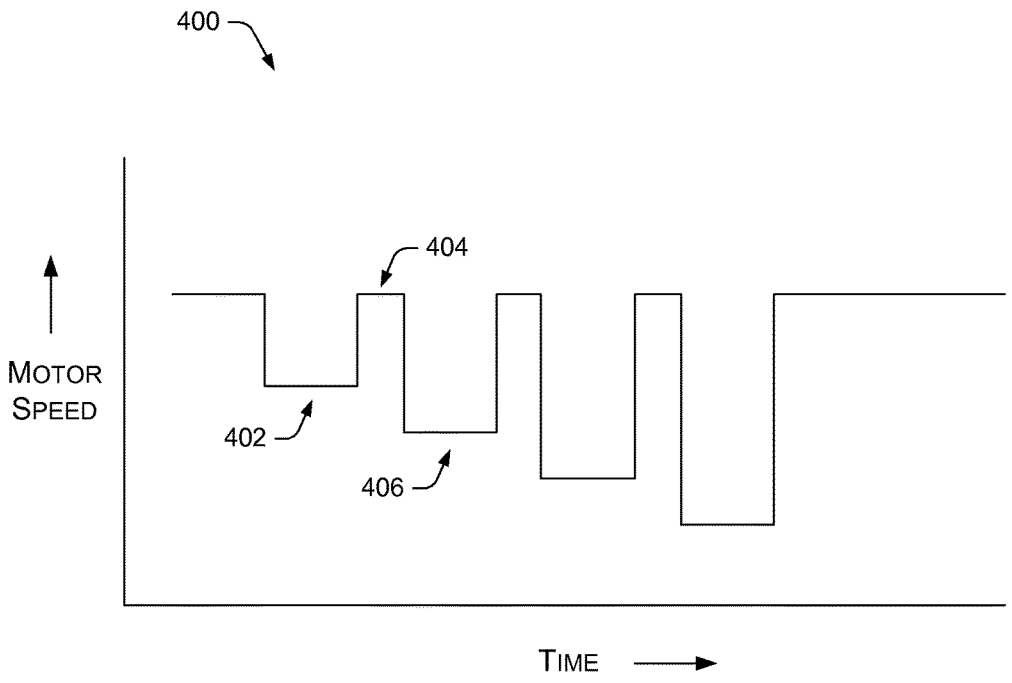
FIG. 4 is a diagram of an example motor speed pattern for resolving a gas lock in an ESP while the ESP is running.

FIG. 4 shows an example motor speed pattern 400 for safely resolving a gas lock in a running ESP 102. In an implementation, the gas lock elimination module 124 may apply smart methods, embodied in such stored motor speed patterns 400, to determine an effective pump speed for breaking the gas lock. Without a measured intake pressure, determining a pump speed that breaks a gas lock can be guesswork. But an example gas lock elimination module 124 can find an effective pump speed by signaling the motor speed controller 126 in accordance with such an example motor speed pattern 400 to vary the motor speed of the ESP 102. For example, the motor speed pattern 400 may vary the motor speed in increasingly deeper troughs, to find an effective gas-lock-breaking pump speed while the pump is still operational, iteratively applying progressively lower pump speeds. The pump 106 eventually arrives at a "highest" low pump speed needed to break the gas lock, without using a lower pump speed than necessary. The gas lock elimination module 124 may also use such an example motor speed pattern 400 to learn a best pump speed for dispelling a gas lock, through trial and error.

In an example motor speed pattern 400, the gas lock elimination module 124 implements a first decreased speed 402 and then reaccelerates to the nominal speed 404 of the ESP 102 to determine if the first decreased speed 402 was successful in breaking the gas lock. The increase in pump speed at the peaks of the motor speed pattern 400, such as reacceleration peak 404, are important between decreased-speed troughs, such as decelerations 402 and 406 in order to determine if the gas lock has been resolved. If the first decreased pump speed 402 does not work to resolve the gas lock, then a second decreased speed 406 that is lower than the first decreased speed 402, is attempted, in an iterative approach. In an implementation, the gas lock elimination module 124 attempts a decreased speed 402 or 406, etc., and if the decreased speed 402 works to resolve the gas lock, then the gas lock elimination module 124 remembers the speed 402, storing the effective speed 402 in data storage.

In an implementation, when the first decreased pump speed 402 of the motor speed pattern 400 does not resolved that gas lock, then the ESP protection module 128 shuts down the ESP 102 to resolve the gas lock while protecting the ESP 102, and tries a lower speed 406 of the example motor speed pattern 400 only on the following detection of a gas lock in the ESP 102. The gas lock elimination module 124 can thus be programmed to store effective pump speeds for resolving a gas lock, or can learn such effective pump speeds for resolving gas lock.

Once the gas lock detector 122 determines that a gas lock is present and the gas lock elimination module 124 initiates a gas lock breaking technique, the gas lock elimination module 124 detects success or failure of the breaking technique and the ESP protection module 128 preserves the integrity or safety of the ESP 102 in case the gas-lock-breaking technique is unsuccessful. In an implementation, the ESP protection module 128 may provide protection if the gas locking is not broken after one trial, for example, as detected by a surface production rate after reaccelerating the ESP 102. Then the ESP 102 is stopped for its own protection.

When the gas lock resolution module 104 has access to flow monitoring (surface or downhole), it is easy to detect successful resolution of the gas lock. Without flow monitoring, however, it can be difficult to determine that the gas lock has been successfully broken. With access to a downhole gauge, a decrease in pump intake pressure (PIP) after an acceleration (e.g., 404) following a gas-break attempt is a reliable indicator that the ESP 102 is pumping fluid again. Additional ways to determine that the gas lock has been broken may be also used. For example, an increase in pump discharge pressure (PDP) during the reacceleration 404 indicates that fluid is entering the tubing and that the ESP 102 is no longer gas locked. An increase in surface temperature of the pumped fluid or surface pressure of the pumped fluid, when surface measures are available, indicate that flow is reaching the surface again. The gas lock resolution module 104 may use these detection techniques, for example, when there is no downhole gauge available.

The gas lock resolution module 104 may also sense an increase in amperage to the ESP 102 compared to amperage at initiation of gas locking to determine success of breaking the gas lock. If the only measured parameter available is amperage, then the amperage at the time the ESP 102 accelerates due to the onset of gas lock may be compared to the initial amperage sensed when the ESP 102 was pumping fluid. When the well starts flowing again, then the amperage being used increases as compared with the relatively load-free state of operation during gas lock.

The ESP protection module 128 may implement protective measures during automated gas lock breaking. For example, during a gas lock breaking process, the protection applied may include stopping the gas lock breaking attempts when there is no success after a time limit. Or, the ESP protection module 128 may stop the ESP 102 when a downhole temperature or a motor temperature has been exceeded before successfully breaking the gas lock. Or again, the ESP protection module 128 may stop the ESP 102 upon exceeding a certain number of attempts without success.

Figure 5:
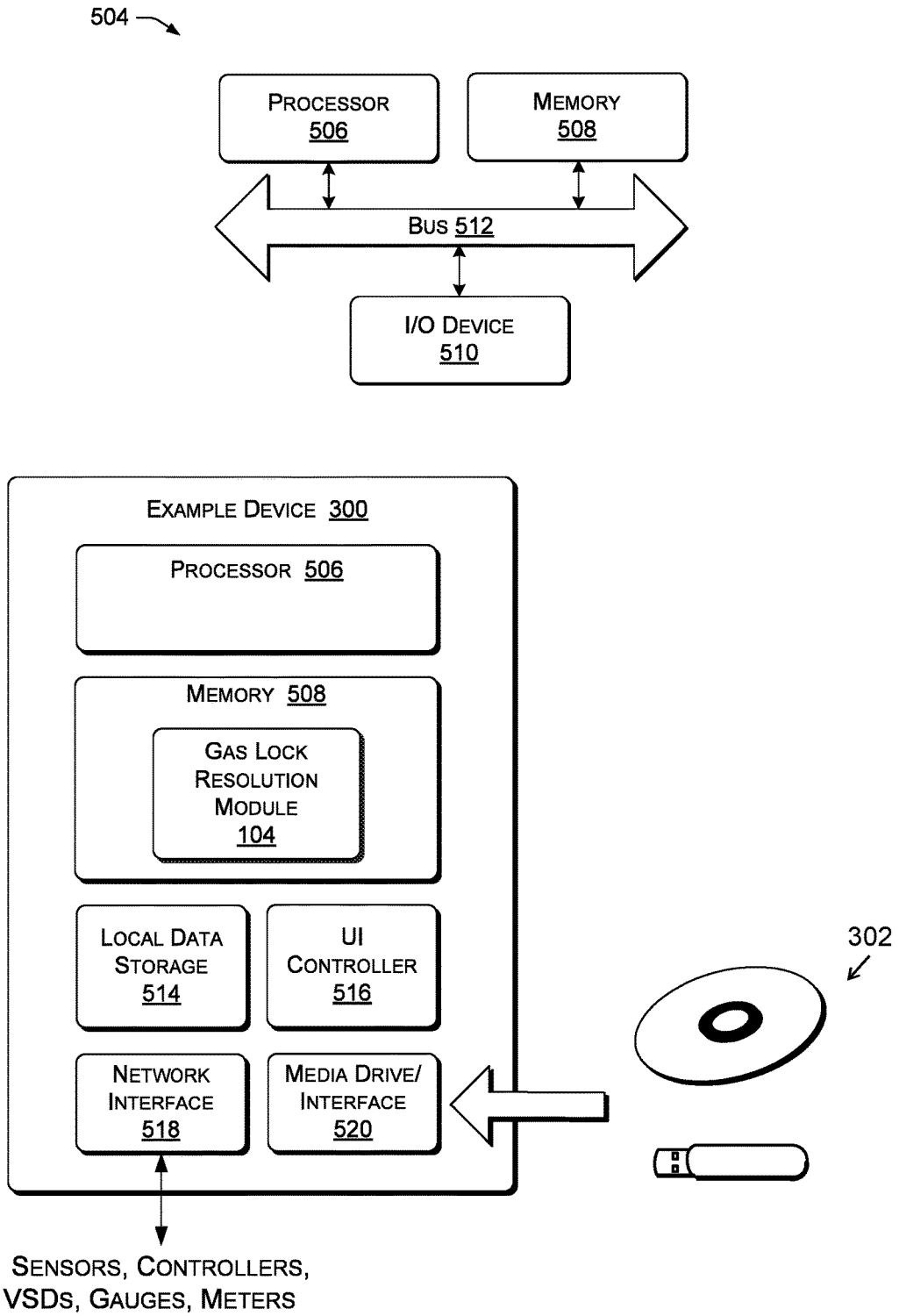
FIG. 5 is a block diagram of an example computing environment for the example gas lock resolution module.

FIG. 5 shows an example computing or hardware environment, e.g., example device 300, for hosting an embodiment of the gas lock resolution module 104. Thus, FIG. 3 illustrates an example device 300, computer, computing device, programmable logic controller (PLC), or the like, that can be implemented to monitor and analyze sensor data, and control or intervene to resolve a gas lock in an ESP 102 and thereby provide improved operation, high reliability, and high-availability to an ESP string 102.

In FIG. 5, the example device 300 is only one example and is not intended to suggest any limitation as to scope of use or functionality of the example device 300 and/or its possible architectures 504. Neither should the example device 300 be interpreted as having any dependency or requirement relating to any one or a combination of components illustrated in FIG. 5.

Example device 300 includes one or more processors or processing units 506, one or more memory components 508, one or more input/output (I/O) devices 510, a bus 512 that allows the various components and devices to communicate with each other, and includes local data storage 514, among other components.

The memory 508 generally represents one or more volatile data storage media. Memory component 508 can include volatile media (such as random access memory (RAM)) and/or nonvolatile media, such as read only memory (ROM), flash memory, and so forth.

Bus 512 represents one or more of any of several types of bus structures, including a memory bus or memory controller, a peripheral bus, an accelerated graphics port, and a processor or local bus using any of a variety of bus architectures. Bus 512 can include wired and/or wireless buses.

Local data storage 514 can include fixed media (e.g., RAM, ROM, a fixed hard drive, etc.) as well as removable media (e.g., a flash memory drive, a removable hard drive, optical disks, magnetic disks, and so forth).

One or more input/output devices 510 can allow a user to enter commands and information to example device 300, and also allow information to be presented to the user and/or other components or devices. Examples of input devices include a keyboard, a cursor control device (e.g., a mouse), a microphone, a scanner, and so forth. Examples of output devices include a display device (e.g., a monitor or projector), speakers, a printer, a network card, and so forth.

A user interface device may also communicate via a user interface (UI) controller 516, which may connect with the UI device either directly or through the bus 512.

A network interface 518 can communicate with hardware, directly or indirectly, such as a VSD 114 or a variable frequency drive (VFD), sensors, flow meters, downhole gauges, valves, and so forth. The network interface 518 may also communicate with the Internet or another network, to send data or receive the gas lock resolution module 104 as instructions from a remote tangible data storage medium 302 such as a remote hard drive or a remote Internet server.

A media drive/interface 520 accepts tangible data storage media 302, such as flash drives, optical disks, removable hard drives, software products, etc. Logic, computing instructions, applications, or a software program comprising elements of the gas lock resolution module 104 may reside on removable tangible data storage media 302 readable by the media drive/interface 520.

Various techniques and the components of the gas lock resolution module 104 may be described herein in the general context of software or program modules, or the techniques and modules may be implemented in pure computing hardware. Software generally includes routines, programs, objects, components, data structures, and so forth that perform particular tasks or implement particular abstract data types. An implementation of these modules and techniques may be stored on or transmitted across some form of tangible computer readable data storage media 302. Computer readable media can be any available data storage medium or media that is tangible and can be accessed by a computing device. Computer readable media may thus comprise computer storage media.

"Computer storage media" include volatile and nonvolatile, removable and non-removable tangible media implemented for storage of information such as computer readable instructions, data structures, program modules, or other data. Computer storage media include, but are not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other tangible medium which can be used to store the desired information, and which can be accessed by a computer or a device 300 with a processor 506 and memory 508.

Representative Processes

Figure 6:
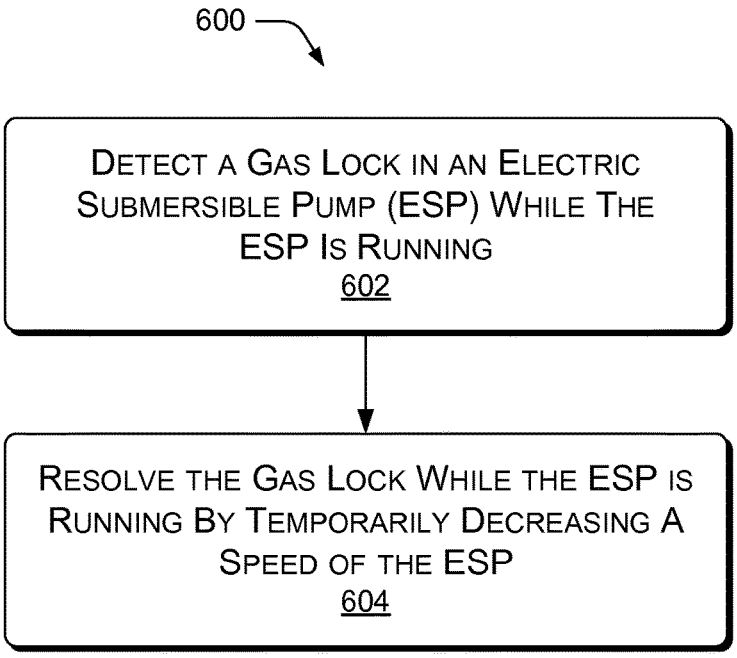
FIG. 6 is a flow diagram of an example process for resolving a gas lock in an example ESP while the ESP is running.

FIG. 6 shows a representative process 600 for resolving a gas lock in a running electric submersible pump (ESP). The example process 600 is shown as individual blocks. The process 600 can be implemented by hardware, or combinations of hardware and machine instructions. For example, the process 600 can be implemented by the example gas lock resolution module 104.

At block 602, a gas lock is detected in an ESP while the ESP is running. The detection may be made directly by sensors, gauges, and meters, or inferred by changes in fluid flow, temperature, input and output pressures, pump speed, amperage consumed at a pump motor 108, and so forth.

At block 604, the gas lock is resolved while the ESP is still running, at least by temporarily decreasing a speed of the ESP, without stopping the ESP. Strategically slowing down the pump allows the equilibrium of the gas and fluid involved in the gas lock to shift, often using the hydrostatic pressure of the fluid column over the pump to flush trapped gas and reestablish pump thrust. However, if a strategic gas lock resolution measure does not work, the process 600 may shut down the pump to protect and ESP and relieve the gas lock.

Figure 7:
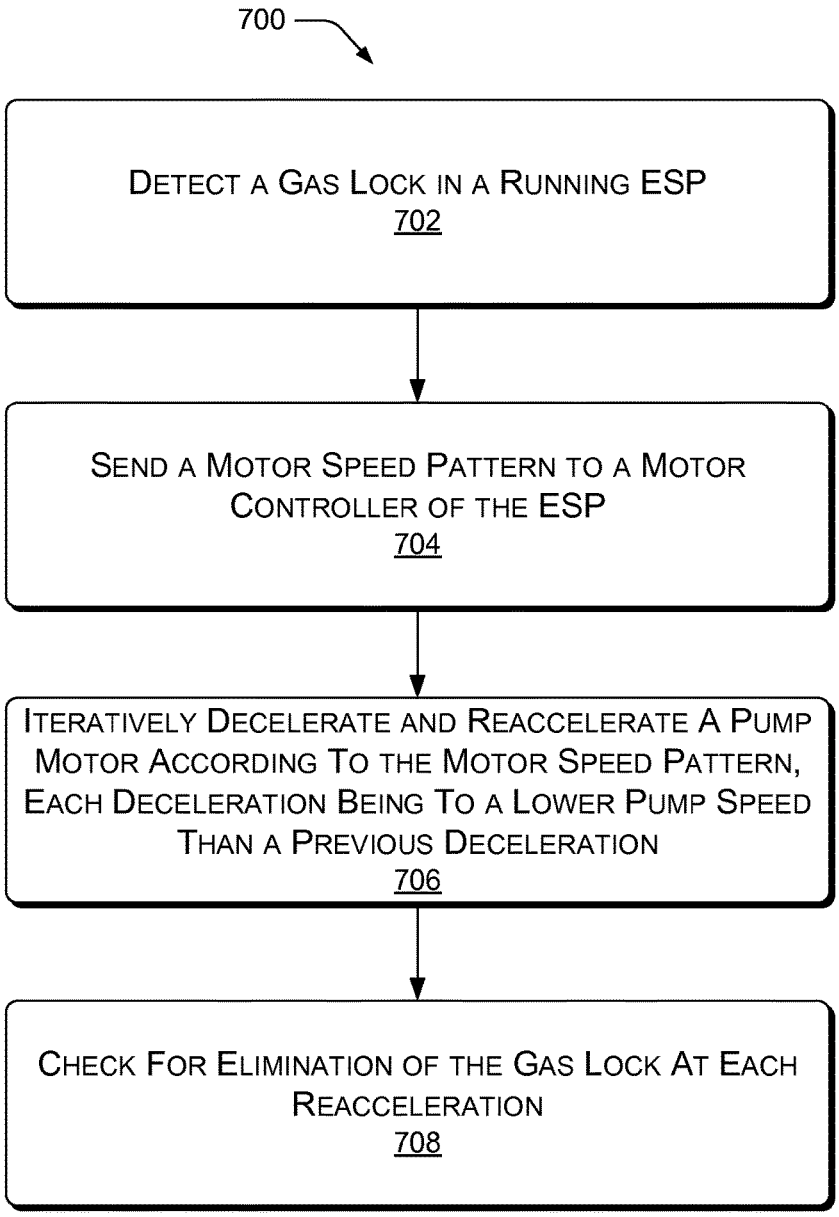
FIG. 7 is flow diagram of an example process for applying a motor speed pattern to a pump motor for resolving a gas lock in an example ESP while the ESP is running.

FIG. 7 shows another representative process 700 for resolving a gas lock in a running electric submersible pump (ESP). The example process 700 is shown as individual blocks. The process 700 can be implemented by hardware, or combinations of hardware and machine instructions. For example, the process 700 can be implemented by the example gas lock elimination module 124.

At block 702, a gas lock is detected in a running ESP string.

At block 704, a motor speed pattern is sent to a motor controller of the ESP.

At block 706, the motor speed pattern iteratively decelerates and reaccelerates the pump motor, with each deceleration descending to a lower pump speed than the previous pump speed deceleration.

Other motor speed patterns may be applied, such as a lower pump speed and a shorter (or longer) duration of deceleration for each successive deceleration trough.

At block 708, elimination of the gas lock is tested for at each reacceleration applied by the motor speed pattern to determine if the gas lock resolution is successful.

CONCLUSION

Although only a few example embodiments have been described in detail above, those skilled in the art will readily appreciate that many modifications are possible in the example embodiments without materially departing from the subject matter. Accordingly, all such modifications are intended to be included within the scope of this disclosure as defined in the following claims. In the claims, means-plus-function clauses are intended to cover the structures described herein as performing the recited function and not only structural equivalents, but also equivalent structures. It is the express intention of the applicant not to invoke 35 U.S.C. § 112, paragraph 6 for any limitations of any of the claims herein, except for those in which the claim expressly uses the words 'means for' together with an associated function.

The invention claimed is:

1. A system, comprising:

an electric submersible pump (ESP);

an ESP controller coupled with the ESP, the ESP being capable of varying a speed of the ESP;

a processor;

a memory; and a gas lock resolution module configured to eliminate a gas lock in the ESP while the ESP is operating as a pump by varying a speed of the ESP, wherein the gas lock resolution module is configured to send a motor speed pattern to the ESP controller; wherein the motor speed pattern iteratively applies different motor speeds to the ESP to eliminate the gas lock, wherein the motor speed pattern causes the ESP to decelerate to successively lower speeds to eliminate the gas lock, wherein the motor speed pattern reaccelerates the ESP between each lower speed to check for elimination of the gas lock.

2. The system of claim 1, wherein the gas lock resolution module is configured to resolve the gas lock while the ESP is operating as a pump by:

calculating a pump speed for attempting a gas lock resolution;

decreasing a speed of the ESP to the calculated pump speed to flush the gas lock; and reaccelerating the ESP to check that the gas lock has been resolved.

3. The system of claim 1, wherein the gas lock resolution module is configured to detect the gas lock in the ESP.

4. The system of claim 1, wherein the gas lock resolution module includes a protection module to prevent the ESP from undergoing damage during gas lock resolution.

5. A method, comprising:

detecting a gas lock in an electric submersible pump (ESP); and resolving the gas lock while the ESP is still running by temporarily decreasing a speed of the ESP, wherein resolving the gas lock further comprises decreasing a speed of the ESP to successively lower pump speeds and reaccelerating the pump speed to a nominal speed between the successively lower pump speeds to check whether each lower pump speed is successful in resolving the gas lock.

6. The method of claim 5, further comprising decreasing the speed of the ESP via the ESP controller.

7. The method of claim 5, further comprising decreasing the speed of the ESP which is a multistage ESP to a point of decreasing a pressure that each stage of the multistage ESP produces, pushing a liquid level lower.

8. The method of claim 7, further comprising decreasing the speed of the multistage ESP to decrease a pressure that the entire multistage ESP produces to a point at which the entire multistage ESP does not support a weight of a fluid in a tubing above the multistage ESP to flush a gas from the multistage ESP.

9. The method of claim 5, wherein detecting the gas lock further includes measuring a surface flow, using a surface flow meter to detect the gas lock, wherein a flow is substantially zero and a speed of the ESP is not zero.

10. The method of claim 5, wherein detecting the gas lock further includes measuring a change in amperage to the ESP to detect the gas lock;

wherein a drop in measured amperage or a stabilization in measured amperage indicates the gas lock in the ESP.

11. The method of claim 5, wherein detecting the gas lock further includes measuring an increase in a pump intake pressure (PIP) or an increase in a downhole annulus pressure near the ESP.

12. The method of claim 5, wherein resolving the gas lock comprises decreasing a speed of the ESP to a motor speed corresponding to an applied frequency of approximately 35 Hertz, for approximately 5 minutes.

13. The method of claim 5, wherein the calculating the effective pump speed for resolving the gas lock comprises measuring the differential pressure ($\Delta P$) during the gas lock and calculating an effective speed w as:

$$\omega = \omega_{REF}\sqrt{\frac{\Delta P}{P_{REF}}}$$

where ($\omega_{REF}$) is a reference frequency of the ESP controller, and ($P_{REF}$) is a pressure that the ESP produces at zero flow at the reference frequency.

14. The method of claim 13, wherein resolving the gas lock comprises implementing a pump speed for resolving the gas lock at a lower pump speed than the calculated effective pump speed as a safety factor to accommodate various densities of fluids being pumped.

15. The method of claim 5, further comprising protecting the ESP during said resolving the gas lock, including one of:

stopping the ESP when the gas lock is not resolved within a time limit;

stopping the ESP when a downhole temperature or a motor temperature of the ESP is exceeded before successfully resolving the gas lock; and stopping the ESP after a certain number of attempts without successfully resolving the gas lock.

* * * * *